United States Patent [19]

Gater

[11] 4,422,677

[45] Dec. 27, 1983

[54] LATCH BOLT HAVING CRANK CAMMING FOR POSITIVE BOLT POSITIONING

[75] Inventor: Arnold C. Gater, Anaheim, Calif.

[73] Assignee: Emhart Industries, Inc., Farmington, Conn.

[21] Appl. No.: 232,986

[22] Filed: Feb. 5, 1981

[51] Int. Cl.[3] ..... E05C 1/06; E05B 65/06

[52] U.S. Cl. ..... 292/139; 70/129; 292/167

[58] Field of Search ..... 292/139, 167, 97, 196, 292/123, 223; 70/129

[56] References Cited

U.S. PATENT DOCUMENTS

| | | | |
|---|---|---|---|
| 1,760,491 | 5/1930 | Grund et al. | 292/139 |
| 2,042,021 | 5/1936 | Schlage | 70/134 |
| 2,296,020 | 9/1942 | Carter | 292/139 |
| 3,065,985 | 11/1962 | Du Four | 70/100 X |
| 3,699,788 | 10/1972 | Gerlach et al. | 292/139 X |
| 4,012,929 | 3/1977 | Solovieff | 70/417 X |
| 4,290,282 | 9/1981 | Wildenradt | 70/218 X |

FOREIGN PATENT DOCUMENTS

| | | | |
|---|---|---|---|
| 110408 | 4/1944 | Sweden | 292/139 |

*Primary Examiner*—Thomas J. Holko
*Assistant Examiner*—R. Illich
*Attorney, Agent, or Firm*—Mahoney & Schick

[57] ABSTRACT

A rotatable crank hub has a crank arm slot pivotally connected to the rearward ends of a pair of driving levers, the forward ends of the driving levers being pivotally connected to a longitudinally slideable bolt. Rotation of the crank hub in opposite directions moves the bolt through the crank arm and driving levers forwardly to bolt extended position and rearwardly to bolt retracted position during which a transverse driving pin between the crank arm and driving lever rearward ends moves into forward vertical slots of the latch frame in the bolt extended position and into rearward vertical slots of the latch frame in bolt retracted position. A cam projection on the crank hub is slideably resiliently engaged at one side approaching and in bolt extended position and the other side approaching and in bolt retracted position by a forward leg of a U-shaped spring, a spring rearward leg being engaged with the latch frame. Thus, the bolt is positively retained in extended and retracted positions by the resilient urging of the driving pin into the forward and rearward frame slots and the spring engagements with the cam projection are preferably formed such that the driving pin is continuously resiliently urged into either of the forward or rearward slots even after positioning in such slots. Also, the forward frame slots may be formed hook-shaped for more positively retaining the driving pin therein once positioned therein.

6 Claims, 8 Drawing Figures

LATCH BOLT HAVING CRANK CAMMING FOR POSITIVE BOLT POSITIONING

BACKGROUND OF THE INVENTION

This invention relates to a latch construction of the type in which a rotatable crank hub drives a bolt between extended and retracted positions through a driving lever or levers having a rearward end pivotally connected to a crank arm of the crank hub through a transverse driving pin and a forward end pivotally connected to the bolt. Furthermore, as the bolt moves into and is placed in the extended position, the driving pin between the crank arm and the driving lever or levers is located in a slot of the latch frame so as to resist outside rearward forces against the bolt attempting to move the same from its extended position. According to the improvements of the present invention, a resilient force is exerted against cam means on the crank hub resiliently urging the driving pin into the frame slot and resiliently resisting removal from the frame slot as the bolt approaches and moves into extended position, thereby more positively insuring the intended functioning of the driving pin and frame slot engagement.

Various prior latch constructions have heretofore been provided wherein it has been attempted to positively secure the bolt thereof in extended position in an effort to frustrate surreptitious attempts at driving the same by use of an outside force from such extended position. For instance, door-mounted latch bolt constructions, usually deadbolt constructions for maximum security, have the bolt thereof in extended position received in a keeper of the door frame. When attempts are made to violate the security of the dead-bolt construction, one of the major areas of attack is against the extended bolt by penetrating either the opening between the door and door frame or directly through the door frame, in both cases applying forces directly against the bolt in an effort to drive it from its extended position toward its retracted position. In an effort to frustrate this bolt driving form of attack, means is provided in addition to the normal bolt moving mechanism for securely retaining the bolt in its extended position, once placed therein, and against this outside force attack thereagainst.

One prominently used prior deadbolt construction having this security increasing means integrated therein has included a rotatable crank hub movable by transversely connected exterior lock and interior lock or hand operators, the crank hub having a radially projecting crank arm which is end pivotally connected to the rearward end of a longitudinal driving lever or levers. The forward end of the driving lever or levers is, in turn, pivotally connected to the rearward end of a usual longitudinally slideable bolt. Thus, limited rotation of the crank hub in one direction moves the bolt from a retracted position totally within a bolt casing longitudinally forwardly to an extended position projecting a determined distance from the bolt casing, and reverse limited rotation of the crank hub similarly moves the bolt from such extended back to its retracted position.

The means for providing the described increased security in the bolt extended position is arranged in conjunction with the pivotal connection between the crank arm of the crank hub and the driving lever or levers. A transversely extending driving pin is used for this pivotal connection and generally vertical slots in the latch frame are located so that when the crank arm and driving lever or levers are moved longitudinally forwardly to place the bolt in its extended position, the final location of the bolt in its extended position also locates this driving pin in the latch frame slots. The overall result is that with the bolt in extended position placing the driving pin in the frame slots, any attempted rearward driving force against the bolt is transmitted longitudinally rearwardly into the driving lever or levers, rearwardly into the driving pin between the driving lever or levers and the crank arm and directly into the slotted latch frame so that the rearward driving force is resisted by the latch frame retaining the bolt extended.

In order to assure that the driving pin always locates fully within the frame slots in the bolt extended position, a spring has been positioned at the pivotal connection between the forward end of the driving lever or levers and the rearward end of the bolt. This spring is positioned such that it tends to urge the operating lever or levers to pivot in proper direction relative to the bolt so that the rearward end of the operating lever or levers, and thus the driving pin is always urged into the frame slots as the bolt approaches its fully extended position. Thus, this spring urged pivoting force at the forward end of the driving lever or levers which is transmitted rearwardly through the driving lever or levers into the driving pin always assures that the driving pin will locate fully within the frame slots when the bolt reaches its fully extended position.

One of the principal difficulties with this prior latch bolt construction in which the security insuring spring is at the forward end of the driving lever or levers is the distance thereof from the driving pin, the motion of which it is required to insure. Obviously, the efficiency of these relatively widely spaced elements is somewhat suspect. Unless the spring, the key to the overall combination, is precisely formed and precisely positioned, the intended result could be partially or totally frustrated.

Other prior latch bolt constructions of similar form have attempted to provide the desired security by use of a different form of spring located in a different manner. A leaf spring is positioned in the latch frame extending longitudinally over the entire of the driving lever and the path of movement thereof. The spring is particularly located so that it is always engaged by the driving lever and the crank arm end at their pivotal connection as the bolt moves into its fully extended position, it thereby being intended to force the driving pin into the frame slots. Again, the efficiency of this structure is questionable and unless all elements are properly formed and assembled, the security insurance described will not be provided.

OBJECTS AND SUMMARY OF THE INVENTION

It is, therefore, an object of this invention to provide a latch bolt construction of the foregoing discussed general character having a combined cam and resilient means arrangement which is located to more positively assure control of the crank arm and driving lever movement so as to, in turn, more positively assure location of the driving pin pivotal connection therebetween in a latch frame slot at least in fully extended bolt positioning. In the preferred embodiment form of the present invention, the rotatable crank hub has cam surface means formed thereon with resilient means bearing thereagainst, these particularly located elements cooperating to positively act as the bolt approaches and moves into its fully extended position for resiliently urging the driving pin into and resiliently resisting removal from the bolt frame slot. Thus, assured positioning of the driving pin in the fully bolt extended position is obtained through forces much more closely positioned to the driving pin location and in a more secure and positive manner than has been possible with the prior security intended relationships.

It is a further object of this invention to provide a latch bolt construction having an increased security arrangement of the more positive nature in the bolt fully extended position which may also be provided with a similar arrangement in the bolt fully retracted position, thereby avoiding inadvertent bolt extension when the same is not desired. Again, in the preferred embodiment of the present invention, once the cam surface means on the rotatable crank hub and the resilient means cooperably actionable therewith is included, it becomes relatively simple with minor additions to provide the same functioning in the bolt fully retracted position. By the proper formation of the cam means on the crank hub and its relationship with the resilient means, positive resilient means urging of the driving pin into latch frame slots at both bolt fully extended and bolt fully retracted positions can be provided if desired.

It is also an object of this invention to provide a latch bolt construction having any or all of the foregoing advantages wherein the resilient urging of the driving pin into the latch frame slot or slots may be accomplished in a preferred embodiment form so that the cooperable cam means and resilient means serve to constantly resiliently urge the driving pin into its frame slot security position or positions throughout the bolt remaining in its particular fully moved position. By particular formation of the cam means and resilient means cooperation, a proper resilient force is always directed through the crank arm and driving lever into the driving pin so as to constantly resiliently urge the driving pin into full frame slot position even after the full bolt positioning has been obtained. Thus, not only is the driving pin positively resiliently urged into and resiliently resisting removal from a particular frame bolt positioning slot or slots during a bolt fully moved positioning, but complete assurance is provided for the driving pin to remain in such slot positioning by a continuous resilient urging once fully within slot retainment, this preferred embodiment form thereby providing the greatest possible security and a distinct improvement over the prior constructions.

Other objects and advantages of the invention will be apparent from the following specification and the accompanying drawings which are for the purpose of illustration only.

DESCRIPTION OF THE BEST EMBODIMENTS CONTEMPLATED

Figure 1:
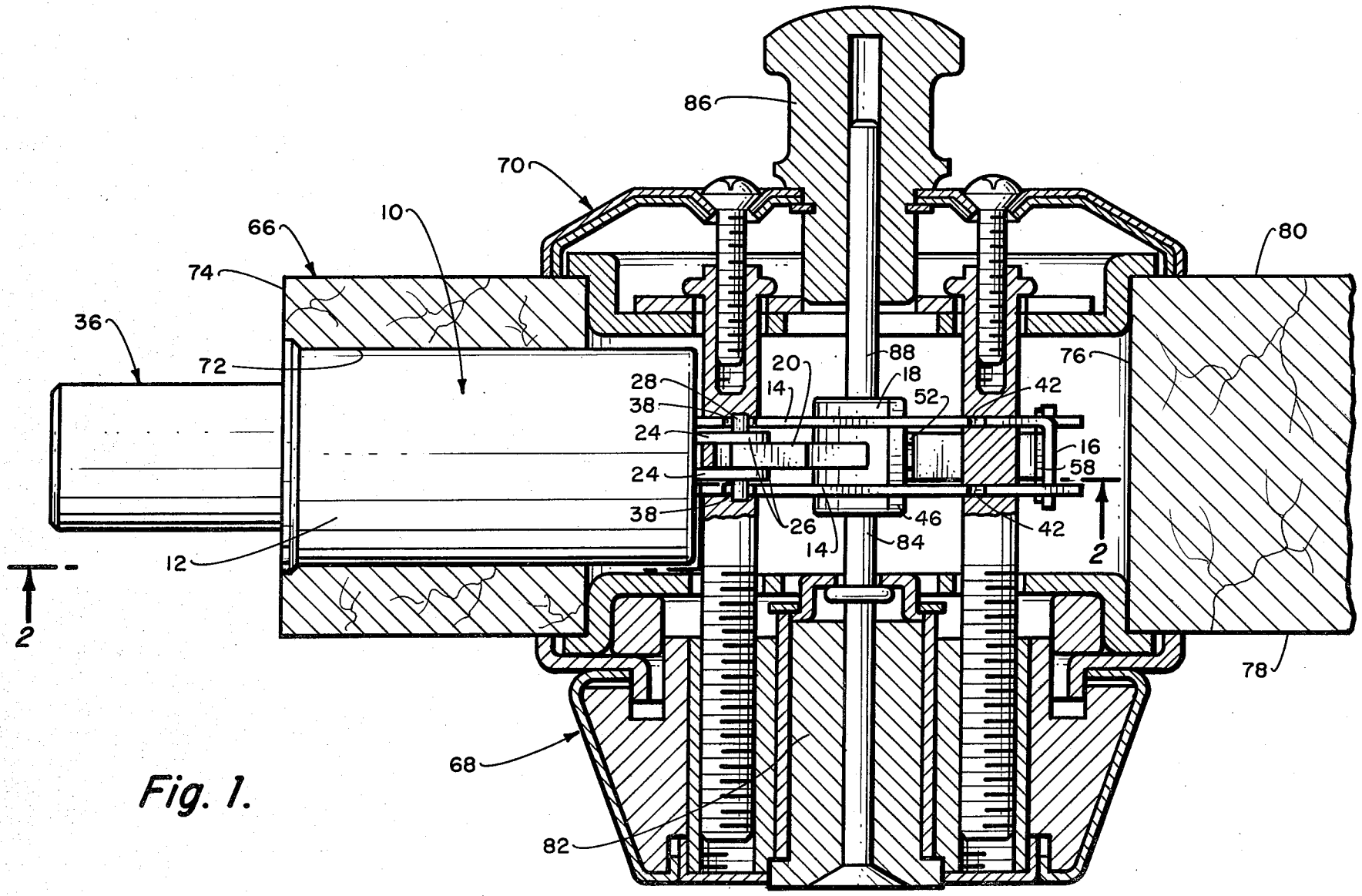
FIG. 1 is a fragmentary, horizontal sectional view of a preferred embodiment of the latch bolt construction of the present invention mounted in a door in bolt extended operable position.

Referring to the drawings, a preferred embodiment of latch bolt construction incorporating the crank camming principles of the present invention is shown. In FIG. 1, the latch bolt construction is shown in a typical door-mounted installation and in the remainder of the drawings removed from the door for purposes of clarity. As an overall matter, the latch bolt construction may be formed of usual materials and by usual manufacturing processes, all well known to those skilled in the art.

Generally, the latch bolt construction includes a stationary frame generally indicated at 10 comprised of a forward tubular bolt casing 12 and rearward transversely spaced side plates 14 terminating rearwardly in a vertically separated end plate 16. A crank hub generally indicated at 18 having a transverse axis is rotatably mounted on and extending transversely through the side plates 14 having a radially extending crank arm generally indicated at 20 projecting upwardly therefrom between the side plates and at various angular positions depending on the rotatable positioning of the crank hub. The crank arm 20 is, in turn, formed with a radial slot 22 transversely therethrough, the slot terminating spaced slightly from the free end of the crank arm and projecting radially inwardly toward the crank hub 18.

A pair of transversely spaced and generally longitudinally extending driving levers generally indicated at 24 have rearward ends 26 slideably abutting transversely opposite sides of the crank arm 20 within the stationary frame side plates 14 and pivotally connected to the crank arm by a transversely extending driving pin 28. The driving pin 28 projects transversely through the crank arm slot 22, oppositely through the driving lever rearward ends 26 and oppositely over upper edges 30 of the stationary frame side plates 14, all for a purpose to be hereinafter described. The driving levers 24 project forwardly from between the stationary frame side plates 14 into the stationary frame bolt casing 12 and have forward ends 32 pivotally connected through a pivot pin 34 to a rearward end of a bolt generally indicated at 36 longitudinally slideable within the bolt casing.

As shown and as thus far described, it will be apparent to those skilled in the art that this preferred embodiment latch bolt construction is a typical deadbolt construction. Furthermore, usual in prior deadbolt constructions, transversely aligned, upwardly opening, bolt extended positioning slots 38 are formed in the upper edges 30 of the stationary frame side plates 14 spaced slightly longitudinally rearwardly of the stationary frame bolt casing 12, the slots 38 being generally vertical slots and having rearward surfaces 40 thereof formed slightly hook-shaped for a purpose to be hereinafter discussed. Also, somewhat similar bolt retracted positioning slots 42 may be formed in the upper edges 30 of the stationary frame side plates 14 longitudinally spaced slightly forwardly of the end plate 16, these being merely generally vertical slots without any special surface configuration. It will be noted that the bolt extended and the bolt retracted positioning slots 38 and 42 are positioned so as to form the longitudinal extremes of movement of the driving pin 28 during extension and retraction of the bolt 36, again, as will be hereinafter discussed more in detail.

Specifically according to the improvements of the present invention, the crank hub 18 has cam means formed on outer surface 44 thereof comprised of a radial projection 46 terminating radially outwardly in an arcuate center surface 48 with relatively flat and angularly extending, similar side surfaces 50. The side surfaces 50 extend angularly inwardly to lesser diameter from the center surface 48 of the radial projection 46 and terminate blending into the smaller normal circumference of the crank hub 18. The radial projection 46 preferably extends transversely or axially of the crank hub 18 the entire transverse or axial length of the crank hub, all as clearly shown in the drawings.

Resilient means preferably in the form of a generally U-shaped spring 52 is positioned in the stationary frame 10 between the side plates 14 rearwardly of the crank hub 18, a forward leg 54 having an end portion thereof bearing against the crank hub radial projection 46, a connecting leg 56 extending rearwardly to the stationary frame end plate 16 and a rearward leg 58 flatwise rearwardly abutting the stationary frame end plate 16 extending upwardly nearly the entire vertical extent of the stationary frame end plate. Spring 52 is retained in assembly by oppositely transversely extending retainment lugs 60 on the spring rearward leg 58 which project through rearwardly opening slots 62 of the stationary frame sideplates 14, the stationary frame end plate 16 being vertically separated at this location as shown. Furthermore, the forward leg 54 of the spring 52 is provided with a central clearance recess 64 opening upwardly at the end portion thereof to provide clearance for the crank arm 20 of the crank hub 18 as will be hereinafter discussed more in detail.

Figure 2:
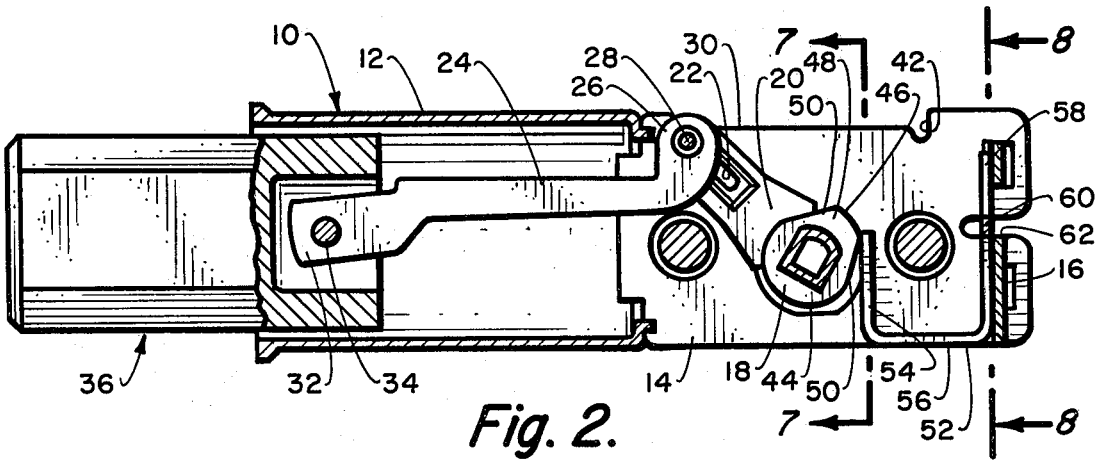
FIG. 2 is a vertical section looking in the direction of the arrows 2—2 in FIG. 1 with the latch bolt construction removed from the door of FIG. 1, but still in extended position and with certain parts broken away and in section to show internal structure.
Figure 3:
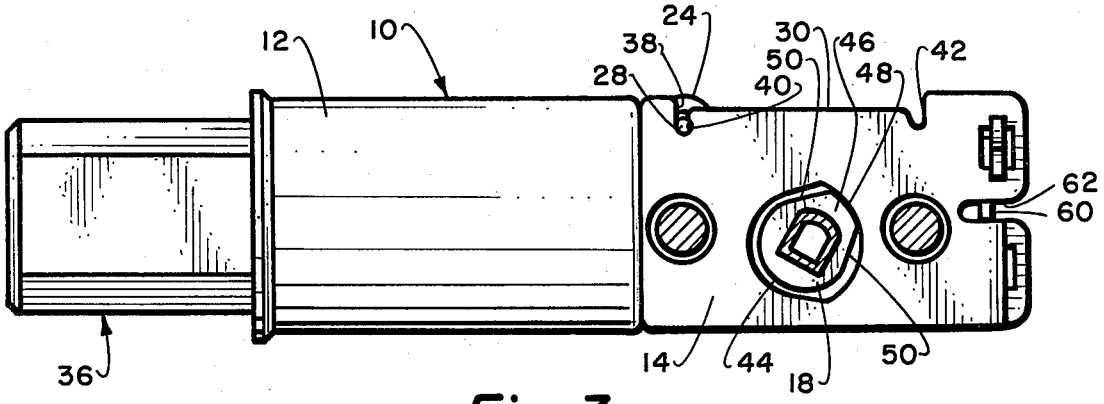
FIG. 3 is a view similar to FIG. 2, but showing the bolt extended latch bolt construction in full side elevation.

The relative positioning between the crank hub radial projection 46 and the crank arm 20 is such that when the crank hub 18 is rotated to move the crank arm 20 thereof forwardly, counterclockwise as shown in FIGS. 2 and 3, to move the bolt 36 through the driving levers 24 to fully extended position moving the driving pin 28 forwardly along the side plates 14 and into the bolt extended positioning slots 38, the center surface 48 of the crank hub radial projection 46 moves forwardly along the forward leg 54 of the spring 52 and ultimately the spring forward leg 54 comes to rest at the rearward side of the crank hub radial projection against the radial projection side surface 50, this bolt fully extended positioning being clearly shown in FIG. 2. During this bolt extended movement, therefore, as the driving pin 28 approaches the bolt extended positioning slots 38, the spring forward leg 54 is beginning to move onto the side surface 50 of the crank hub radial projection 46 so as to exert a resilient force tending to resiliently urge the crank hub 18 in this direction of rotation, counterclockwise in this case, with this resilient urging continuing to positively resiliently urge the driving pin 28 into the bolt extended positioning slots 38, thereby positively positioning the driving pin 28 in the bolt extended positioning slots 38 upon the bolt 36 finally reaching its fully extended position. Furthermore, in this final bolt extended position and with the driving pin 28 fully within the bolt extended positioning slots 38, it is preferred that the spring forward leg 54 will still be angularly displaced from full flatwise abutment with the particular side surface 50 of the crank hub radial projection 46 as shown in FIG. 2 so that even after the driving pin 28 is fully within the bolt extended positioning slots 38 in its full forward positioning, the driving pin is still continuously resiliently urged downwardly into the bolt extended positioning slots by the resilient urging of the spring 52 against the crank hub radial projection 46.

Figure 4:
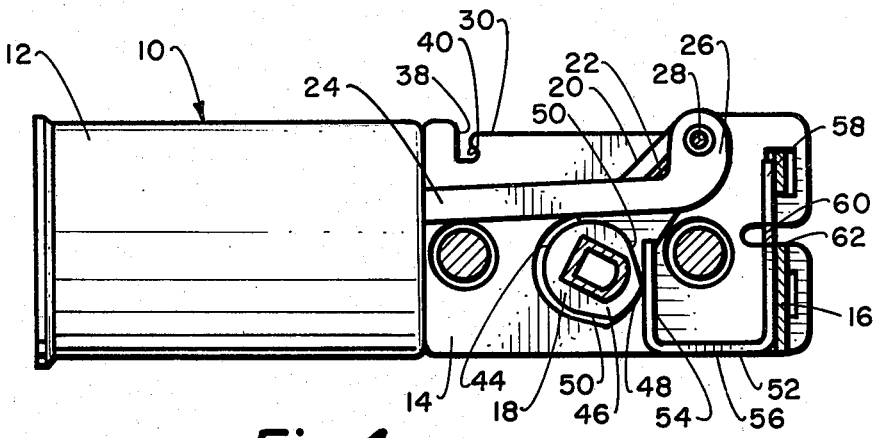
FIG. 4 is a view similar to FIG. 2, but with the latch bolt construction in bolt fully retracted postion.
Figure 5:
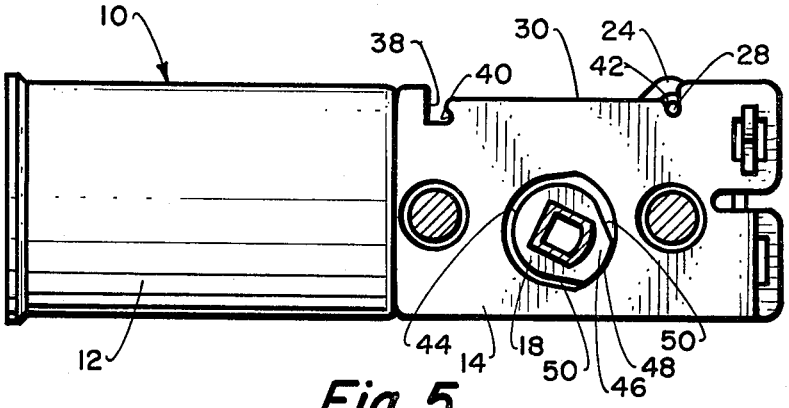
FIG. 5 is a view similar to FIG. 3, but with the latch bolt construction in bolt fully retracted position.
Figure 6:
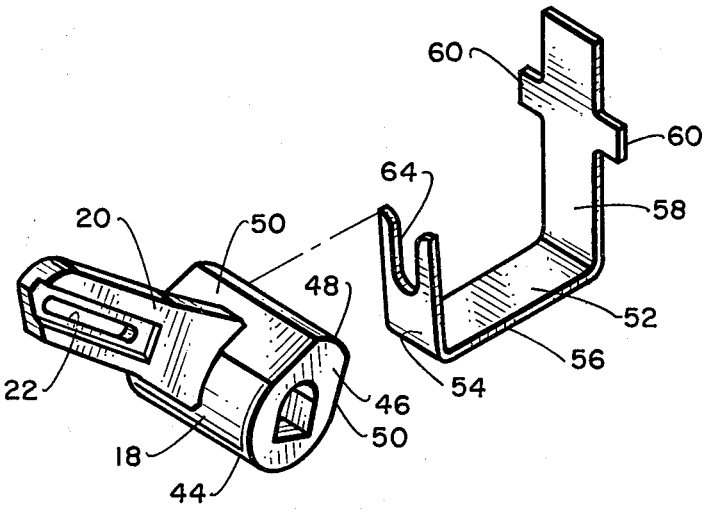
FIG. 6 is an enlarged, perspective view showing the crank hub with a preferred embodiment of cam means formed thereon and a preferred embodiment of resilient means in the form of a spring removed from the latch bolt construction of FIGS. 1 through 5.
Figure 7:
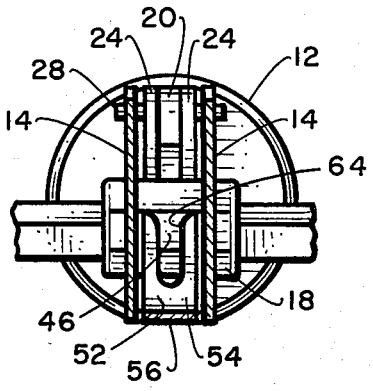
FIG. 7 is an enlarged, fragmentary, vertical sectional view looking in the direction of the arrows 7—7 in FIG. 2.
Figure 8:
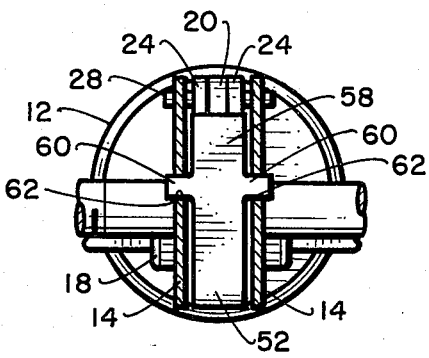
FIG. 8 is an enlarged, fragmentary, vertical sectional view looking in the direction of the arrows 8—8 in FIG. 2.

Reverse rotation of the crank hub 18 or clockwise as shown in FIGS. 2 through 5 moves the bolt 36 from its fully extended position of FIGS. 2 and 3 to its fully retracted position as shown in FIGS. 4 and 5. The crank arm 20 through the driving levers 24 moves the bolt 36 rearwardly while lifting the driving pin 28 upwardly out of the bolt extended positioning slots 38 and ultimately rearwardly downwardly into the bolt retracted positioning slots 42. The center surface 48 of the crank hub radial projection 46 slides reversely rearwardly along the spring forward leg 54 and the crank hub 18 ultimately comes to rest with the spring forward leg 54 just over the edge of the center surface and beginning to contact the end of the particular side surface 50 as clearly seen in FIG. 4, the spring 52 again preferably not obtaining full flatewise abutment with the particular radial projection and side surface 50. Thus, again, not only is the driving pin 28 resiliently urged into the bolt retracted positioning slots 42 as it approaches the slots, but once it is in these slots with the bolt in fully retracted position as shown in FIGS. 4 and 5, it is still constantly resiliently urged downwardly into these slots.

In a typical door-mounted use of the preferred embodiment of latch bolt construction incorporating the crank camming principles of the present invention, as shown in FIG. 1, the latch bolt construction is mounted in a door generally indicated at 66, for example, with an outside lock cylinder operator generally indicated at 68 and an inside hand operator generally indicated at 70. The bolt casing 12 of the stationary frame 10 is received in a longitudinal latch opening 72 of the door 66, the bolt casing terminating flush with door edge 74. The bolt casing 12 projects longitudinally rearwardly into a transverse latch opening 76 of the door 66 so that the side plates 14 and the crank hub 18 thereof are transversely aligned with the outside lock cylinder operator 68 secured in assembly against an outer door face 78 and the inside hand operator 70 secured against an inner door face 80. As is usual, a lock plug 82 of the outside lock cylinder operator 68 is connected through torque blade 84 and a hand knob 86 of the inside hand operator 70 is connected through a torque blade 88 with the crank hub 18, the torque blades and crank hub being non-rotatable relative to each other.

In operation of the latch bolt construction in this door-mounted positioning and starting from the bolt fully retracted position as shown in FIGS. 4 and 5, the bolt retracted from the position shown in FIG. 1, rotation of either of the outside lock cylinder operator 68 or the inside hand operator 70 in the usual manner rotates the crank hub 18 counterclockwise as shown in FIGS. 4 and 5 moving the crank arm 20, the driving levers 24 and consequently the bolt 36 forwardly to project the bolt from the door edge 74 and into a usual keeper (not shown) in a usual door frame (not shown). As the bolt 36 approaches and finally reaches its fully extended position as shown in FIGS. 1, 2 and 3, the resilient engagement of the spring 52 against the radial projection 46 of the crank hub 18 resiliently urges the driving pin 28 into the bolt extended positioning slots 38 of the stationary frame side plates 14. Simultaneously with the bolt 36 reaching its fully extended position as shown in FIGS. 1, 2 and 3, the driving pin 28 is fully received downwardly within the bolt extended positioning slots 38 downwardly rearwardly facing the hook-shaped slot rearward surfaces 40. Furthermore, due to the particular relationship between the U-shaped spring 52 and the crank hub radial projection 46 as described and clearly shown in FIG. 2, the driving pin 28, even after the final full positioning takes place, is still constantly continuously urged resiliently into this final slot engaged positioning, thereby assuring that the same will be maintained throughout the time that the bolt 36 is in this fully extended position.

This places the latch bolt construction and, therefore, the door 66 in which it is mounted in locked position. During this lock positioning, if surreptitious attempts are made to drive the bolt 36 rearwardly by penetration through the space between the door and door frame or through the door frame, rearward movement of the bolt will be securely resisted by the driving pin 28 engaged with the stationary frame side plates 14 through the bolt extended positioning slots 38. The hook-shaped configuration of the rearward surfaces 40 of the bolt extended positioning slots 38 will resist any possible movement of the driving pin 28 out of this stationary frame side plate 14 engagement, and the described particular relationship between the U-shaped spring 52 and the crank hub radial projection 46 constantly resiliently urging the driving pin 28 into and fully within the bolt extended positioning slots 38 will positively assure that the correct security positioning between the driving pin and the bolt extended positioning slots will always remain during bolt fully extended positioning. Thus, maximum protection against surreptitious bolt driving in an attempt to violate the security of the latch bolt construction will be frustrated.

Movement of the bolt 36 from the door locking fully extended position as shown in FIGS. 1, 2 and 3 to the door unlocking fully retracted position as shown in FIGS. 4 and 5 is accomplished by reversely rotating the crank hub 18 through either of the outside lock cylinder operator 68 or the inside hand operator 70 in the usual manner. Rotation of the crank hub 18 in the clockwisewise direction as viewed in FIGS. 2 through 5 will withdraw the bolt 36 rearwardly fully into the bolt casing 12 causing the driving pin 28 to be resiliently urged fully into the bolt retracted positioning slots 42 as shown in FIGS. 4 and 5. As with the bolt in fully extended position, this driving pin 28 engagement in the bolt retracted positioning slots 42 with the bolt in fully retracted position will be assured to be retained for as long as desired due to the constant resilient urging into this pin and slot engagement resulting from the particular relationship between the U-shaped spring 52 and the crank hub radial projection 46. This bolt retracted pin and slot engagement will assure that the bolt will not be inadvertently move from its fully retracted position from vibratory forces or otherwise.

According to the principles of the present invention, therefore, a unique latch bolt construction has been provided wherein the security retention of the bolt thereof at least in its fully extended position has been marketly improved over the prior constructions. Resilient means at the crank hub thereof provides a resilient force in closer proximity to the latch bolt elements upon which it must act for urging the elements into and resiliently retaining them in the ultimate maximum security producing position. Furthermore, in the preferred embodiment, once the latch bolt construction elements have been resiliently urged into the final maximum security producing position, through a unique positioning relationship between the resilient means and crank hub radial projection, these elements are still maintained with resilient urging thereagainst throughout such positioning so as to guarantee that such maximum security producing positioning is always maintained when intended.

Although the principles of the present invention have been herein illustrated in a particular embodiment of latch bolt construction, it is not intended to limit such principles to that construction alone, since the same principles are readily applicable to various other forms of latch bolt constructions. Thus, the principles of the present invention should be broadly construed and not limited beyond the specific limitations set forth in the appended claims including the patent equivalents thereof.

I claim:

1. In a latch construction of the type having a crank hub rotatable in a frame about a transverse axis with a crank arm extending radially therefrom, a longitudinal driving lever with a rearward end pivotally connected to an end portion of the crank arm through a transverse driving pin, a forward end of the driving lever pivotally connected to a longitudinally reciprocal bolt, forward movement of the crank arm by rotation of the crank hub moving the bolt through the driving lever forwardly to an extended position in which the driving pin is simultaneously moved into a generally vertical bolt positioning slot in the frame, the driving pin and bolt positioning slot engagement resisting rearward movement of the bolt out of the extended position from an outside force against the bolt, rearward movement of the crank arm by rotation of the crank hub initially withdrawing the driving pin from the bolt positioning slot while moving the bolt to a retracted position; the improvements including: cam surface means on said rotatable crank hub and resilient means bearing thereagainst cooperably actionable as said bolt approaches and moves into said extended position for resiliently urging said driving pin through said crank hub and crank arm into and resiliently resisting removal from said frame bolt positioning slot; said resilient means including a generally U-shaped spring resiliently bearing between said cam surface means and said frame having a leg abutting said cam surface means and a leg abutting said frame.

2. In a latch construction as defined in claim 1 in which said spring and said cam surface means being configured relative to each other constantly resiliently urging said driving pin into said frame bolt positioning slot after said driving pin is positioned in said frame bolt positioning slot.

3. In a latch construction as defined in claim 1 in which said bolt positioning slot in said frame is an extended bolt positioning slot; in which rearward movement of said crank arm by said rotation of said crank hub moves said bolt through said driving lever rearwardly to said retracted position during which said driving pin is simultaneously moved into a generally vertical retracted bolt positioning slot in said frame; and in which said cam surface means and said resilient means are also cooperably actionable as said bolt approaches and moves into said retracted position for resiliently urging said driving pin through said crank hub and crank arm into and resiliently resisting removal from said frame retracted bolt positioning slot.

4. In a latch construction as defined in claim 1 in which said bolt positioning slot in said frame is an extended bolt positioning slot; in which rearward movement of said crank arm by said rotation of said crank hub moves said bolt through said driving lever rearwardly to said retracted position during which said driving pin is simultaneously moved into a generally vertical retracted bolt positioning slot in said frame; and in which said cam surface means and said resilient means are also cooperably actionable as said bolt approaches and moves into said retracted position for resiliently urging said driving pin through said crank hub and crank arm into and resiliently resisting removal from said frame retracted bolt positioning slot, said spring and said cam surface means being configured relative to each other constantly resiliently urging said driving pin into either of said extended and retracted bolt positioning slots after said driving pin is positioned in either of said bolt positioning slots.

5. In a latch construction as defined in claim 1 in which said cam surface means on said crank hub includes a radial cam projection, said spring having a leg abutting said radial cam projection and a leg abutting said frame urging said driving pin into said frame bolt positioning slot as said bolt approaches and moves into said extended position.

6. In a latch construction as defined in claim 1 in which said cam surface means on said crank hub includes a radial cam projection, said spring having a leg abutting said radial cam projection and a leg abutting said frame urging said driving pin into said frame bolt positioning slot as said bolt approaches and moves into said extended position, said spring and radial cam projection also being configured relative to each other for constantly resiliently urging said driving pin into said frame bolt positioning slot after said driving pin is positioned in said frame bolt positioning slot.

* * * * *